US010137340B2

(12) United States Patent
Fay

(10) Patent No.: US 10,137,340 B2
(45) Date of Patent: Nov. 27, 2018

(54) GOLF PUTTER WITH ANIMAL BONE INSERT

(71) Applicant: Bernard Fay, Des Plaines, IL (US)

(72) Inventor: Bernard Fay, Des Plaines, IL (US)

( * ) Notice: Subject to any disclaimer, the term of this patent is extended or adjusted under 35 U.S.C. 154(b) by 0 days.

(21) Appl. No.: 15/891,842

(22) Filed: Feb. 8, 2018

(65) Prior Publication Data

US 2018/0221729 A1 Aug. 9, 2018

Related U.S. Application Data

(60) Provisional application No. 62/456,648, filed on Feb. 8, 2017.

(51) Int. Cl.

| | |
|---|---|
| ***A63B 53/08*** | (2015.01) |
| ***A63B 53/04*** | (2015.01) |
| ***A63B 53/00*** | (2015.01) |
| *A63B 102/32* | (2015.01) |

(52) U.S. Cl.

CPC ..... *A63B 53/0487* (2013.01); *A63B 53/007* (2013.01); *A63B 53/04* (2013.01); *A63B 53/08* (2013.01); *A63B 2053/042* (2013.01); *A63B 2053/0408* (2013.01); *A63B 2053/0416* (2013.01); *A63B 2053/0425* (2013.01); *A63B 2053/0429* (2013.01); *A63B 2102/32* (2015.10); *A63B 2209/00* (2013.01)

(58) Field of Classification Search

CPC ..... A63B 53/08; A63B 53/0487; A63B 53/04; A63B 2053/0408; A63B 2053/0416; A63B 2053/042; A63B 2053/0425; A63B 2053/0429

USPC ..... 473/340, 342, 349

See application file for complete search history.

(56) References Cited

U.S. PATENT DOCUMENTS

| | | | | | |
|---|---|---|---|---|---|
| 1,383,654 | A * | 7/1921 | Mattern | A63B 53/04 | 473/342 |
| 1,423,341 | A * | 7/1922 | Lippincott | A63B 53/04 | 473/342 |
| 1,435,318 | A * | 11/1922 | Mattern | A63B 53/04 | 473/342 |
| 1,449,559 | A * | 3/1923 | Relle | A63B 53/04 | 473/342 |
| 1,494,494 | A * | 5/1924 | Lippincott | A63B 53/04 | 473/342 |

* cited by examiner

*Primary Examiner* — Benjamin Layno

(74) *Attorney, Agent, or Firm* — Richards Patent Law P.C.

(57) ABSTRACT

A putter head includes: a striking face formed from a first material, the striking face including a central cavity; and an insert formed from a second material that is different from the first material, wherein the second material comprises animal bone, the insert including a front face and a back face, the back face fittingly engaged within the central cavity to align the front face with the face geometry surrounding the central cavity thereby establishing a continuous surface along the striking face.

10 Claims, 3 Drawing Sheets

GOLF PUTTER WITH ANIMAL BONE INSERT

BACKGROUND OF THE INVENTION

The present subject matter relates generally to a golf club that uses an animal bone insert in a contact surface. More specifically, the present invention relates to a golf putter with animal bone insert on the ball striking face of the club.

Golf clubs are designed for use in hitting golf balls in a variety of ways, all of which require an appropriate applicable force and accuracy in order to most expeditiously propel the golf ball toward a designated target. Various golf clubs are used to provide various propelling functions. The initially used driver is designed for use in providing maximum lofted propulsion over a large distance (usually measured in hundreds of yards). Putters, used in the final approach to the hole, are at the opposite end of the golf spectrum wherein distance is subservient to extreme accuracy in causing the ball to be propelled across the ground and into the hole or cup. The art of putting has eluded perfection by even the most ardent and talented golfers. Yet, the number of putts required to sink the ball often represents as much as half of the golfer's total score. Since a golfer is limited to a single putter over an entire round of play, the nature of the putter is important in permitting a golfer to play the best possible game.

Putting requires a high degree of skill and accuracy in which a properly designed club can enhance a player's natural and learned abilities. Numerous factors, which often involve tradeoffs, are taken into account in the design of a club head for a putter and which relate to the putter's action during the swing and upon impact with the ball. These factors include moment of inertia, lateral dispersion, weight, club head material, shape of the striking face, shaft alignment, sighting means and face balance. Such factors relate to the rotational stability of the club during the swing, the maximum energy transfer from the club to ball, the balance, the resistance to twisting upon impact with the ball, even if hit off center, and the ability of the club to impart the maximal rotational energy on the golf ball to produce a natural rolling motion from point of impact.

Many golfers learn to "feel" their putters. The point of contact between the ball and the putter face being of critical importance to this feel. A golfer's score benefits greatly from good putting and good putting depends in large part on the golfer's comfort and confidence in his or her putter, much of which is based on whether the putter feels like a natural extension of the golfer's body. It may be beneficial, therefore, to provide a putter that feels like a natural and organic part of the putting stroke.

Accordingly, there is a need for a golf putter that uses a natural and organic material, such as animal bone insert, as described herein.

BRIEF SUMMARY OF THE INVENTION

To meet the needs described above and others, the present disclosure provides a golf putter with animal bone insert on the ball striking face of the club.

In one embodiment, the present invention comprises an insert member of animal bone for a golf putter, with one face of the insert being adapted to fittingly engage the striking face of a head of the golf putter by means of adhesive, mechanical fasteners, or other fastening means, including by frictional fit, when the insert is fitted within a cutout on the face of the putter. The other face of the insert, which is thereby situated in a putting position for engagement with a golf ball, comprises a regular, planar surface. The planar surface is longitudinally positioned in alignment with a longitudinal axis of the putter head and is preferably of a dimension and position for putting engagement with a golf ball.

In a primary example, a putter head includes: a striking face formed from a first material, the striking face including a central cavity; and an insert formed from a second material that is different from the first material, wherein the second material comprises animal bone, the insert including a front face and a back face, the back face fittingly engaged within the central cavity to align the front face with the striking face surrounding the central cavity thereby establishing a continuous surface along the striking face.

The animal bone may be any natural bone, such as cow bone, alligator bone, etc.

The insert may be secured within the central cavity by an adhesive, by one or more mechanical fasteners, or other fastening mechanism.

In some examples, the insert has a depth between 1/64 of an inch to 1/8 of an inch.

In some examples, the insert has a density between 2.1 g/cm3 to 2.2 g/cm3.

In other examples, the insert has a density between 2.0 g/cm3 to 2.2 g/cm3.

In further examples, the insert comprises two or more animal bones tiled, bonded, or otherwise linked together to form a bone insert.

In another example, a putter head includes: a striking face formed from a first material, the striking face including a central cavity; and an insert formed from a second material comprising animal bone, the insert including a front face and a back face, the back face adhered within the central cavity to align the front face with the striking face surrounding the central cavity thereby establishing a continuous surface along the striking face; wherein the insert has a depth between 1/64 of an inch to 1/8 of an inch and a density between 2.0 g/cm3 to 2.2 g/cm3.

It is an object of the present invention to provide a putter with traditional aesthetics, but with improved ball striking capability. Animal bone is readily available and typically discarded after butchering animals, etc. Bone is all natural, organic, and when processed appropriately, provides a smooth and resilient ball striking face.

An advantage of utilizing animal bone is that every vertebrate in the world has bones. Upon expiration, typically these bones are left to decompose or ground up for use as bone meal, etc. The present invention enables recycling of an organic compound which prevents the need to produce costly metal alloys, carbon fiber, etc. while still offering a customizable putting face thanks to vertebrates varying bone density.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

DETAILED DESCRIPTION OF THE INVENTION

Figure 1:
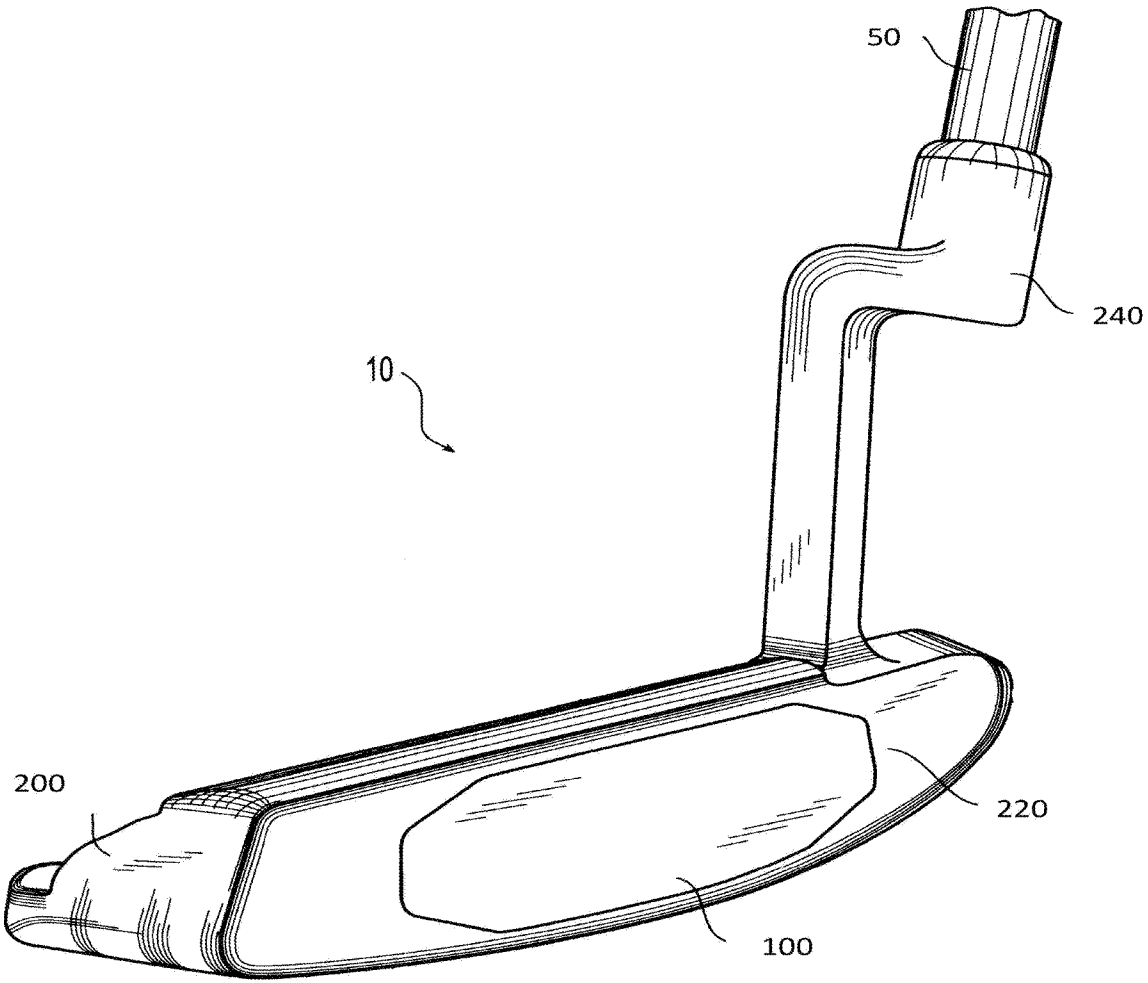
FIG. 1 is a perspective view of a putter head including an animal bone insert on the ball striking face of the club.

FIG. 1 illustrates an example of a putter 10 including an insert 100 comprising animal bone. As shown in FIG. 1, the insert 100 is positioned within in a central cavity 210 in a striking face 220 of the putter head 200 such that the insert 100 spans the "sweet spot" of the striking face 220 (defined as the area of the putter head 200 designed to contact the ball with a balanced swing). Also shown in FIG. 1, the putter 10 includes a shaft 50 which connects to putter head 200 through a hose) 240, which acts as the attachment point between putting head 200 and shaft 50.

The striking face 220 of the putter head 200 may be formed from a material that is different from the insert 100. For example, the striking face 220 may be formed from, for example, stainless steel, titanium, composites, etc.

Figure 2:
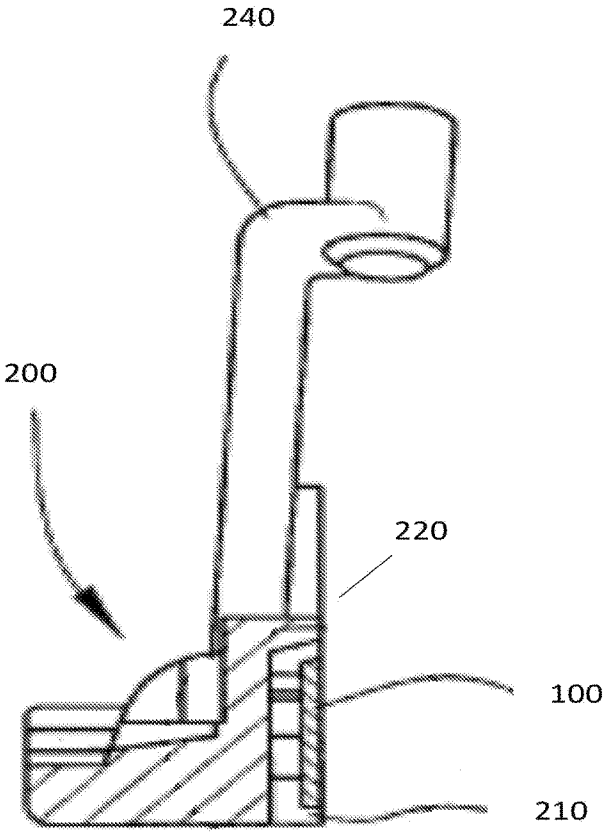
FIG. 2 is across-sectional side view of the putter head of FIG. 1.

FIG. 2 is a cross-sectional side view of the putter head 200 including an insert 100 comprising animal bone. As shown in FIG. 2, the insert 100 is fittingly engaged within the central cavity 210 to provide a uniform, smooth plane along the striking face 220. The insert 100 may be secured within the cavity 210 of the putter head 200 preferably by means of high strength epoxy. When attaching by epoxy, the epoxy mixture may be placed in the cavity 210 of the putter head 200 and on a corresponding surface of the bone insert 100. The longitudinal axis of the insert 100 is aligned with the longitudinal axis of putter head 200 prior to adhesion. Alternatively, the insert 100 may be attached by bolts, screws, integral latches or another method of secure and lasting attachment.

In the example shown in FIG. 2, the putter head 200 includes an insert 100 formed from animal bone. This insert 100 is located within the cavity 210 which was milled into the striking face 220 of the putter 10. In one non-limiting example, the depth of the milled cavity 210 may be between 1/64-1/8 of an inch in depth. As shown, when within the cavity 210, the outer face of the animal bone insert 100 sits flush with the face 220 of the putting head 200 to provide a continuously smooth, uniform striking face 200.

Figure 3A:
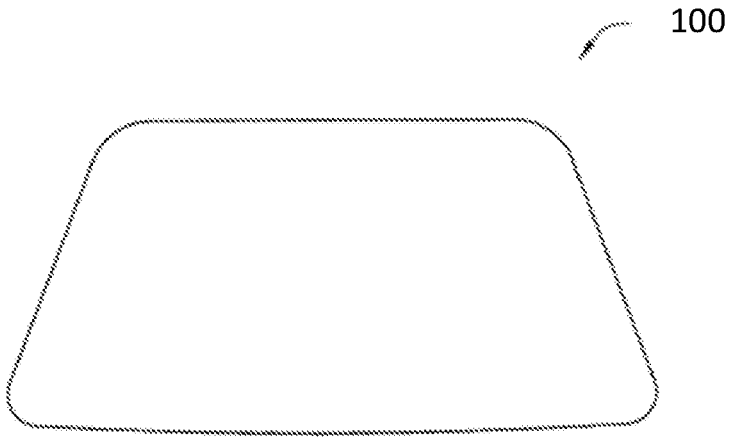
FIG. 3A is a front view of an animal bone insert.

FIG. 3A is a front view of an animal bone insert 100. As shown in FIG. 3A, the animal bone insert 100 may be trapezoidal in shape with the bottom portion of the insert 100 having a greater width then the top. Any other geometric shape may be utilized for a bone insert 100 (i.e., oval, square, rectangle, etc.) with the shape of the insert 100 being mirrored by the cavity 210.

Figure 3B:
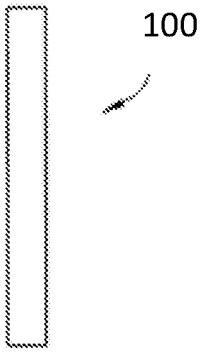
FIG. 3B is a side vide of an animal bone insert.

FIG. 3B is a side vide of an animal bone insert 100. As shown in FIG. 3B, the animal bone insert 100 may have a smaller depth than width (see FIG. 3A) which gives it a wide profile for striking the ball but shallow depth profile. This shallow depth reduces the size of the cavity 210 that must be milled or otherwise created for the insert 100. As noted in FIG. 2, the depth of the insert 100 should match with the cavity 210 so that when set within the striking face 220 the outward face of the insert 100 is flush with the rest of the striking face 220.

Depending on user preference, the insert 100 can be concave, convex, or flat relative to the rest of the striking face 220 depending on functional advantage or user preference.

An advantage of utilizing bone as an insert 100 is the ability to tune the striking characteristics of the putter 10 using natural materials. Every golfer has their own preference about the feel of the putter they prefer to use. Some enjoy a putter that provides a lot of "spring" off the striking face 220 while others prefer a less reactive, deadening effect from their putter 10. In some putters 10, these effects are achieved by the use of different metals, alloys, and polymers in the striking face 220. For organically produced materials, wood had been a common choice for golf clubs in the past. However, this material is not durable nor is it sought out for putting due to irregularities in the density of wood which leads to inconsistent striking properties.

Animal bone offers an organic material which is typically uniform in density (throughout a single bone) and without the irregularities seen in wood (e.g., no grain pattern, knots, etc.). Further, generally speaking, each type of animal has a different bone density. For example, mice and other small mammals have lower bone density (0.003 g/cm2 for mice), while larger types of bovine (2.1 g/cm2 for cows) have higher bone density. For example, elephants have amongst the densest animal bones. Each bone density provides a different coefficient of restitution when striking a ball and thus a different putting experience to the end user. Users can determine what type of bone insert 100 they enjoy using and get a good deal of enjoyment out of what otherwise might have been an unused waste material.

Bone density is proportional to bone stiffness and strength (yield stress). Dense bone is stiffer and stronger than less-dense bone, but it is also heavier. The overall shape of a bone affects its stiffness (but not necessarily its strength). Therefore, if an end user wanted a durable insert 100 the user may opt for a cow bone insert 100. Conversely, if a user instead wants a lighter putter 10, the user may opt for an insert 100 formed from mouse bone, etc.

In one preferred embodiment, the animal bone insert 100 may be made from a cow's femur. Adult cow (Bos Taurus) femurs vary in size but are typically 14 to 18 inches long and 4 to 6 inches wide. The size of such a bone provides plenty of material to create an animal bone insert 100 and the insert 100 may be preferred by those who want a dense animal bone insert 100 (cow bone density averages between 2.1-2.2 g/cm3).

In another embodiment, the bone of an exotic animal species may be utilized to create the animal bone insert 100. The American alligator (Alligator Mississippiensis) is a common nuisance on golf courses in the southern United States and thus there may be an appeal to consumers to use a putter 10 featuring alligator bone insert 100. Adult alligator femurs, while smaller than those of a cow, are still typically between 5 to 7 inches long and 2 to 3 inches wide. This provide sufficient material to create an animal bone insert 100.

The skeletons of birds (and other flying vertebrates) need to be lightweight to minimize the metabolic cost of flight, and at the same time strong enough to withstand the forces encountered during flight. It may be surprising to learn that birds (and bats) actually have bones which are quite dense (2.0-2.2 g/cm3), heavy, and durable. However, the size of the femur bone of a sparrow (*Plocepasser mahali*) is around 0.78 inches long and 0.2 inches wide. Such small bones may be tiled, bonded, or otherwise linked together to form a bone insert 100 to provide yet another option for golfers.

It should be noted that some embodiments of the presently disclosed animal bone insert 100 will be constructed from pure, unadulterated animal bone. The animal bone insert 100 in these embodiments will contain no polymers, plastics, or rubbers; nor any organic filler compounds such as collagen.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A putter head comprising:

a striking face formed from a first material, the striking face including a central cavity; and an insert formed from a second material that is different from the first material, wherein the second material comprises animal bone, the insert including a front face and a back face, the back face fittingly engaged within the central cavity to align the front face with the striking face surrounding the central cavity thereby establishing a continuous surface along the striking face.

2. The putter head of claim 1, wherein the animal bone is cow bone.

3. The putter head of claim 1, wherein the animal bone is alligator bone.

4. The putter head of claim 1, wherein the insert is secured within the central cavity by an adhesive.

5. The putter head of claim 1, wherein the insert is secured within the central cavity by one or more mechanical fasteners.

6. The putter head of claim 1, wherein the insert has a depth between 1/64 of an inch to 1/8 of an inch.

7. The putter head of claim 1, wherein the insert has a density between 2.1 g/cm3 to 2.2 g/cm3.

8. The putter head of claim 1, wherein the insert has a density between 2.0 g/cm3 to 2.2 g/cm3.

9. The putter head of claim 1, wherein the insert comprises two or more animal bones.

10. A putter head comprising:

a striking face formed from a first material, the striking face including a central cavity; and an insert formed from a second material comprising animal bone, the insert including a front face and a back face, the back face adhered within the central cavity to align the front face with the striking face surrounding the central cavity thereby establishing a continuous surface along the striking face;

wherein the insert has a depth between 1/64 of an inch to 1/8 of an inch and a density between 2.0 g/cm3 to 2.2 g/cm3.

* * * * *